United States Patent [19]

Pfarrwaller et al.

[11] 4,122,873

[45] Oct. 31, 1978

[54] CONTROL MEANS FOR CONTROLLING THE WARP LET-OFF OF A WEAVING MACHINE

[75] Inventors: Erwin Pfarrwaller, Winterthur; Eberhard Seifert, Sulz-Attikon, both of Switzerland

[73] Assignee: Sulzer Brothers Limited, Winterthur, Switzerland

[21] Appl. No.: 836,359

[22] Filed: Sep. 26, 1977

[30] Foreign Application Priority Data

Sep. 27, 1976 [CH] Switzerland ..... 12184/76

[51] Int. Cl.[2] ..... D03D 49/10

[52] U.S. Cl. ..... 139/110; 66/211

[58] Field of Search ..... 139/24, 25, 105, 109, 139/110; 242/75.5, 75.45, 75.51; 66/209, 210, 211, 212

[56] References Cited

U.S. PATENT DOCUMENTS

| | | | |
|---|---|---|---|
| 2,430,639 | 11/1947 | Jacques | 139/110 |
| 2,450,488 | 10/1948 | Schedin | 139/110 |
| 3,072,154 | 1/1963 | Locher | 139/110 |
| 3,878,872 | 4/1975 | Hintsch | 139/110 |

FOREIGN PATENT DOCUMENTS

| | | | |
|---|---|---|---|
| 621,310 | 6/1961 | Italy | 139/110 |

*Primary Examiner*—Henry S. Jaudon

*Attorney, Agent, or Firm*—Kenyon & Kenyon, Reilly, Carr & Chapin

[57] ABSTRACT

The pulse transmitter is synchronized with the weaving cycle of the machine drive and carries at least one sensing surface of variable shape. A detector is secured to the tension beam and is responsive to changes in warp tension. The detector carries a sensing element in the form of a proximity switch which is disposed over the sensing surface of the pulse transmitter. Depending upon the position of the proximity switch relative to the sensing surface, a pulse is emitted to the warp beam drive for stepping of the warp beam as the pulse transmitter rotates past the sensing element. This pulse is variable in the time-of-occurrence as well as in duration.

18 Claims, 7 Drawing Figures

CONTROL MEANS FOR CONTROLLING THE WARP LET-OFF OF A WEAVING MACHINE

This invention relates to a control means for a warp let-off of a weaving machine.

As is known, weaving machines have been provided with various types of controls for controlling the warp let-off during weaving. In a conventional case wherein a motor is used to step the warp beam in a periodic manner, the position of a spring-biased tension bar or beam is used to control the motor. In this case, a proximity switch has been used which is responsive to the positions of the tension beam so as to switch on and off. Depending upon the position of the proximity switch, the motor for the warp beam is switched on and off. However, one of the disadvantages of this device is that the inertia of the tension beam frequently causes the proximity switch to remain "on" for longer than necessary in relation to the warp length actually required. For example, the "on" time may extend over a number of weaving cycles or picks with the result that the structure of the produced cloth contains irregularities.

Accordingly, it is an object of the invention to provide a control means for controlling a warp beam drive so as to avoid irregularities in a woven cloth.

It is another object of the invention to provide a control means for controlling the warp let-off of a weaving machine which is of relatively simple construction.

Briefly, the invention provides a weaving machine which has a machine drive and a warp beam drive for rotating a warp beam in an incremental motion with a control means for controlling the warp beam drive. The control means includes a movably mounted detector which is responsive to a change in warp tension, a pulse transmitter which is adapted to move in synchronism with a weaving cycle of the machine drive and in relative relation with the detector, at least one sensing surface of variable shape on one of the detector and transmitter and a sensing element on the other of the detector and transmitter. The sensing element is disposed to travel over the sensing surface in order to emit a pulse to the warp beam drive for stepping the warp beam. This pulse corresponds to the operative distance which the sensing element travels over the sensing surface such that the pulse is variable in time-of-occurrence and in duration.

The warp beam drive is thus adapted to be acted upon by a pulsating electrical signal which is dependent upon the warp tension and/or warp length as well as upon the weaving cycle.

The control means coordinates the pacing or stepping of the warp with the picking frequency. Stepping of the warp can occur, for example, at every pick or at every other pick or at every fourth pick.

In one embodiment, the pulse transmitter is in the form of a disc while the sensing surface extends radially on the disc and is bounded either by a cardioid curve or an involute curve. In this case, the sensing element which may be in the form of a proximity switch is able to pass over the sensing surface along selected circular arcs of different arcuate extent depending upon the position of the sensing element relative to the sensing surface.

In another embodiment, the pulse transmitter is in the form of a cylinder while the sensing surface is disposed on the generated surface of the cylinder. In this case, the sensing surface may be substantially triangular such that the sensing element travels across circular arcs of varying circumferential extent.

These and other objects and advantages of the invention will become more apparent from the following detailed description and appended claims taken in conjunction with the accompanying drawings in which:

FIG. 1 illustrates a diagrammatic view of a first embodiment of a control means used in a weaving machine for terry cloth in accordance with the invention;

FIG. 1*a* illustrates a perspective view of the pulse transmittor and detector of the control means of FIG. 1;

FIG. 2 illustrates a diagrammatic view of a second embodiment of the control means used in a plain weaving machine in accordance with the invention;

FIG. 2*a* illustrates a view taken on line 2*a*—2*a* of FIG. 2;

Figure 1:
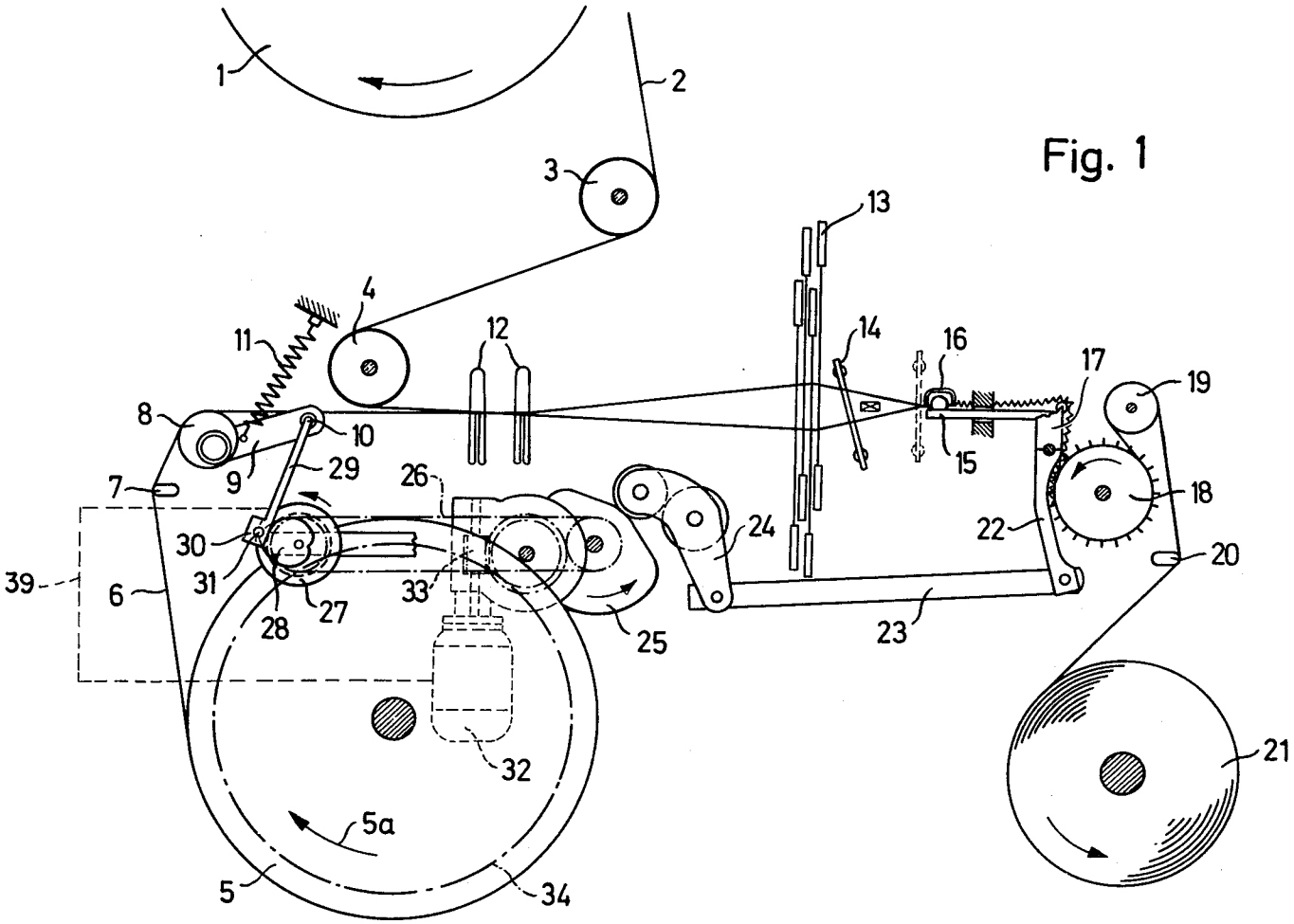

Referring to FIG. 1, the weaving machine for weaving terry cloth employs a ground warp beam 1 from which ground warps 2 are supplied over a deflecting beam 3 and a tension bar or beam 4. In addition, a pile warp beam 5 is rotatably mounted within the machine to supply pile warps 6 which pass over a temple 7 to a resiliently mounted tension bar or beam 8. The tension beam 8 is secured to a pair of levers 9 which are pivotable about a pivot 10 in known fashion. In addition, a spring 11 is secured to a lever 9 at one end as well as to a fixed part of the frame at an opposite end in order to restore the levers 9 and, thus, the tension beam 8 to a neutral position.

As shown, the warps 2, 6 extend in a conventional manner to a warp stop motion 12, shafts 13 and a reed 14 for weaving with a weft yarn (not shown) into a terry cloth. The cloth which is produced runs over a slider 15 associated with a temple 16, a moving breast beam 17, a needle-clothed stepping beam 18, a pressing beam 19, a temple 20 and, finally, a cloth beam 21 on which the cloth is wound. As indicated, the breast beam 17 is connected via links 22, 23 with a cam follower lever 24. The cam follower lever 24, in turn, coacts with a rotatable cam 25 for controlling the cloth movement from the machine. This cam 25 is actuated by a machine drive (not shown).

The warp beam 5 is driven via a motor 32. To this end, the motor 32 has a worm gear 33 which drives a tooth ring 34 on the warp beam 5.

Figure 1A:
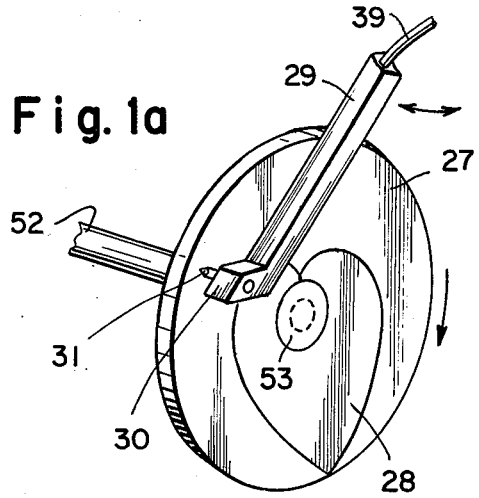

A control means for controlling the warp beam drive includes a movably mounted detector 29 which is responsive to a change in warp tension and a pulse transmitter 27 which is adapted to move in synchronism with the weaving cycle of the machine drive and in relative relation with the detector 29. As shown in FIG. 1, the detector 29 is connected to the levers 9 and is pivotable about the pivot 10. The pulse transmitter 27 is in the form of a rotatable disc which is mounted on a shaft 52 and is connected via a chain drive 26 to the cam 25 and thus to the machine drive so as to move in synchronism therewith. In addition, the control means has a sensing surface 28 of variable shape which extends radially on the pulse transmitting disc 27 (FIG. 1*a*) and encompasses a non-active area 53 around the shaft 52. The control means also has a sensing element in the form of a proximity switch 30 disposed on the detector 29 in order to travel over the sensing surface 28. As indicated, the proximity switch has a substantially punctate switching zone 31. The switching zone 31 moves in the manner of a pick-up needle of a record player over the sensing surface 28 without necessarily touching the surface 28, as is well known in the art with respect to proximity switches.

In operation, as the length of warp extending around the tension beam 8 varies in accordance with the requirements for pile warp 6 near the weaving shed, the lever pairs 9 pivot about the pivot 10. This results in a simultaneous pivoting of the detector 29 so that the proximity switch 30 moves radially of the rotating disc 27. When the rotating sensing surface 28 coincides with the zone 31 of the proximity switch 30, a pulse is emitted from the switch 30 via a suitable line 39 motor 32 for stepping the warp beam 5. When the motor 32 is energized, the warp beam 5 rotates in the direction indicated by the arrow 5*a* to let off warp.

Figure 3:
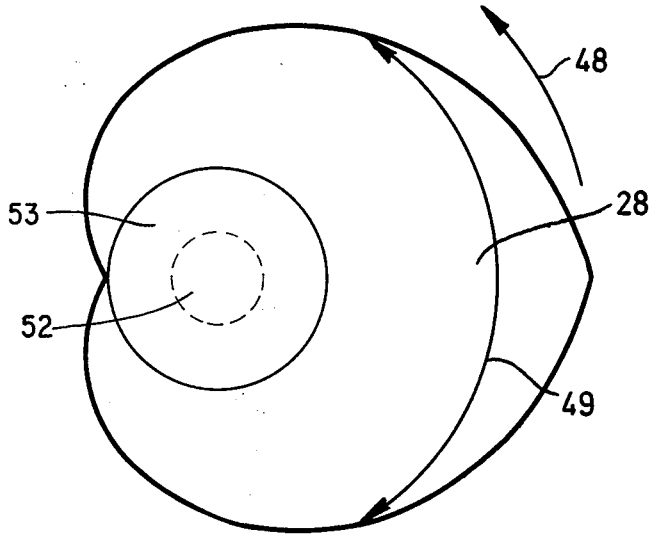
FIG. 3 illustrates a plain view of one type of sensing surface used in accordance with the invention.

The "on" time of the beam 5 is determined by the movement path of the proximity switch 30 along the sensing surface 28. To this end, as shown in FIG. 3, the sensing surface 28 is bounded by a cardioid curve. Further, since the sensing surface 28 rotates with the disc 27 about a fixed axis, the proximity switch 30 on the detector 29 travels along a circular arc 49. As shown, depending upon the position of the proximity switch relative to the axis of rotation of the disc 27, the circular arc 49 may be of different arcuate extents. The direction of rotation of the sensing surface 28 is indicated by the arrow 48. The sensing surface 28 can be an electrically conductive and/or dielectric exciting zone which cooperates with the proximity switch 30 to energize the warp beam drive (i.e. motor 32). Alternatively, the sensing surface 28 can be a magnetic and/or optical exciting zone for cooperation with the proximity switch to energize the motor 32.

Figure 4:
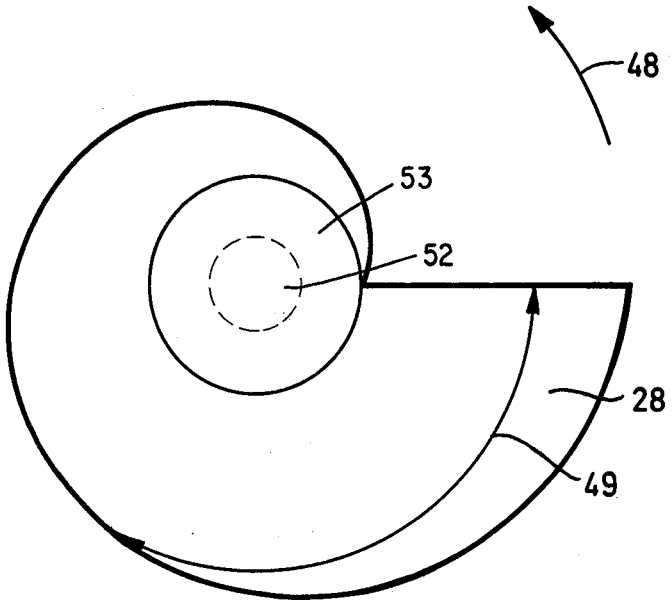
FIG. 4 illustrates a further embodiment of a sensing surface used in accordance with the invention.

Referring to FIG. 4, wherein like reference characters indicate like parts as above, the sensing surface 38 may be bounded by an involute curve.

Figure 2A:
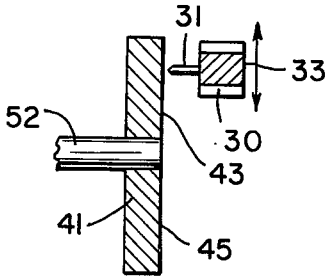
Figure 2:
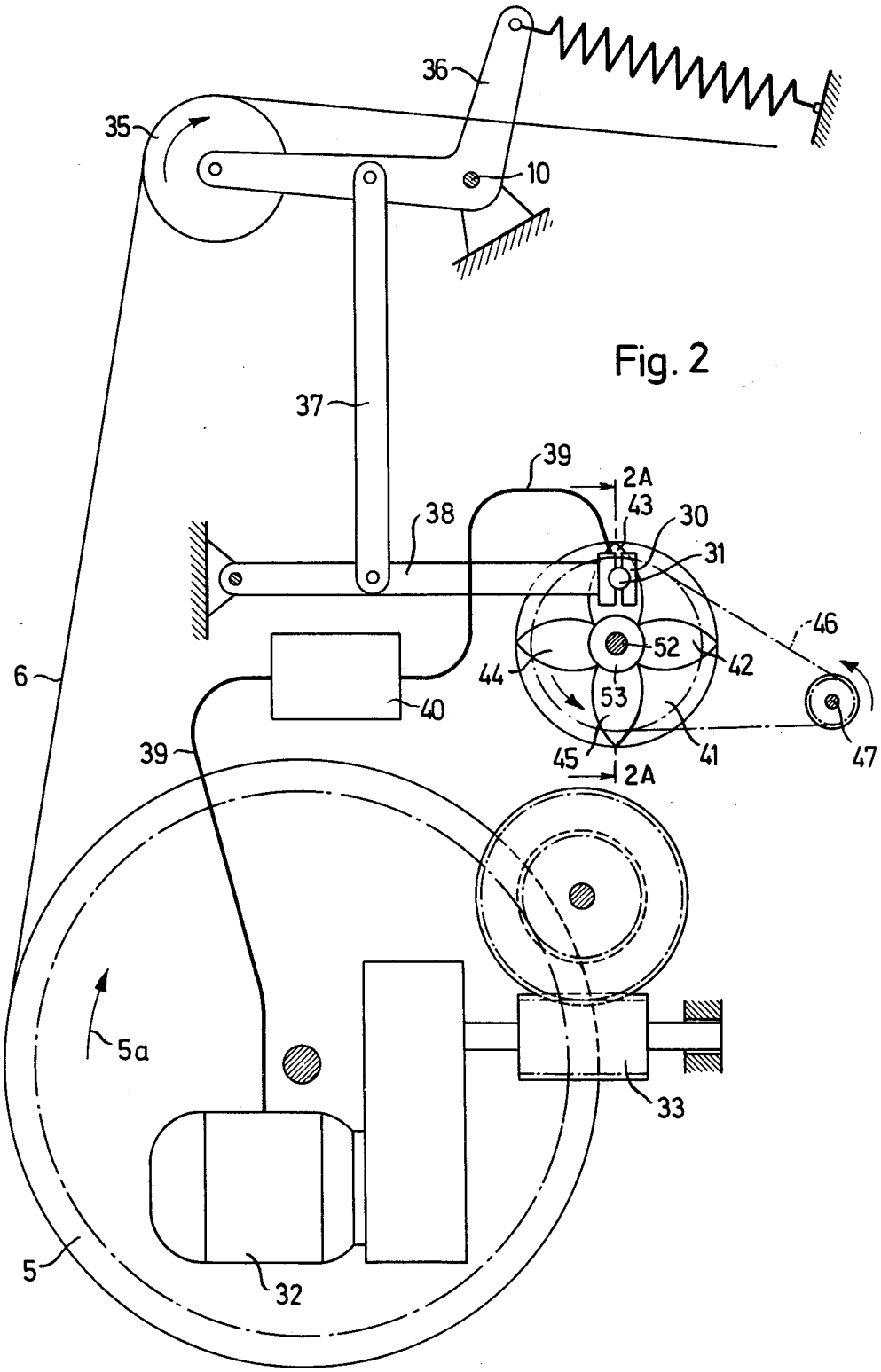

Referring to FIG. 2, wherein like reference characters indicate like parts as above the weaving machine may be of the plain weaving type which includes a rotating tension bar or beam 35 over which warps 6 are supplied from a warp beam 5. As above, the warp beam 5 is driven by a drive which constitutes a motor 32. As shown, the motor 32 drives the warp beam 5 via a worm gear 33 and the toothed ring on the warp beam 5. The tension beam 35 is carried on a pair of bell crank levers 36 which are pivoted about a pivot 10 and which are spring biased by a spring 11 to the weaving machine frame.

The control means for controlling the warp beam drive includes a detector 38 which is connected via a link 37 to the bell crank levers 36 and a rotating pulse transmitting disc 41 which is coupled via a reduction transmission 46 to a shaft 47 of the machine drive. In addition, the detector 38 carries a proximity switch 30 which is positioned over a sensing surface on the pulse transmitting disc 41 (FIG. 2*a*). As shown in FIG. 2, the switch 30 is connected via a line 39 to a motor switch 40 for selectively energizing the motor 32. In addition, the sensing surface on the disc 41 is formed of four surfaces 42 – 45, each of which is of variable shape.

The operation of the control means of FIG. 2 is similar to that as described above with respect to FIG. 1 and no further description is believed to be necessary.

Figure 5:
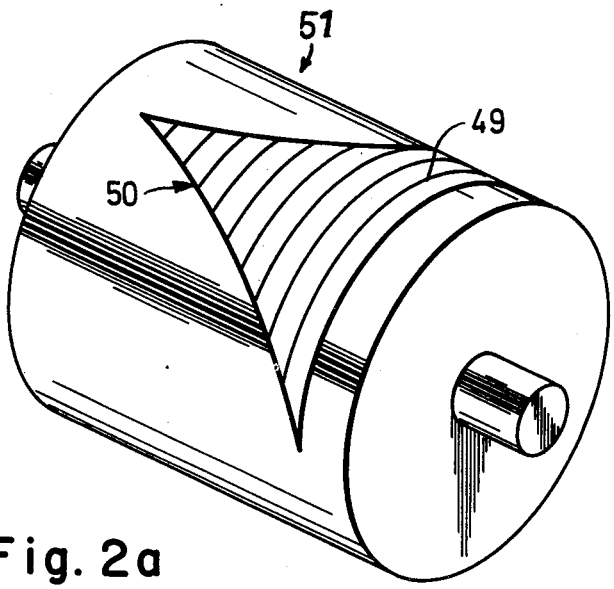
FIG. 5 illustrates a modified pulse transmitter and sensing surface in accordance with the invention.

Referring to FIG. 5, the pulse transmitter may alternatively be in the form of a cylinder 51 with at least one substantially triangular sensing surface 50 which extends along the generated surface of the cylinder. This cylinder 51 cooperates with a switch (not shown) which moves axially of the cylinder 51. Alternatively, the pulse transmitter may be linear, for example, in strip or band or similar form.

In each of the above described embodiments, the sensing element 30 is disposed to travel over the sensing surface 28 in order to emit a pulse to the warp beam drive for stepping the warp beam in an incremental fashion. The pulse corresponds to the operative distance which the sensing element 30 travels over the sensing surface 28 whereby the pulse is variable in time-of-occurrence and in duration. As shown in FIGS. 3 and 4, the length of the circular arcs 49 and, therefore, the "on" time increases towards the center of the rotating disc 28. The shape, adjustment and peripheral velocity of the sensing surface 28 can be chosen to give the optimum instant of switch-on for weaving. Where the pulse transmitter is in the form of a cylinder 51 as shown in FIG. 5, the circular arcs are disposed about the axis of the cylinder 51 and are of decreasing circumferential extent towards one end of the cylinder.

The frequency with which the sensing element 30 cooperates with the sensing surface 28 is variable relative to the picking frequency. As a rule, the sensing surface 28 passes by the proximity switch 30, at most, once per weaving cycle or pick. Consequently, depending upon the number of sensing surfaces, the warp can be stepped at every pick, at every other pick or at every fourth pick. In the case of the weaving machine for terry cloth as shown in FIG. 1, the disc 27 may run at the same speed as the cam 25 for moving the cloth, i.e. at one revolution per group of picks or per row of loops. In the case of the plain weaving machine as shown in FIG. 2, the rotating disc 41 runs at $\frac{1}{4}$ the speed of the machine.

It is to be noted that the proximity switch 30 can be disposed on the rotating disc 27 so that the switching zone 31 is arranged for rotation while the sensing surface is disposed on the detector 29. In this case, the sensing surface 28 would be movable in a linear manner.

What is claimed is:

1. In a weaving machine, the combination comprising
- a machine drive;
- a warp beam drive for rotating a warp beam in an incremental motion; and
- a control means for controlling said warp beam drive, said control means including
- a movably mounted detector responsive to a change in warp tension,
- a pulse transmitter adapted to move in synchronism with a weaving cycle of said machine drive and in relative relation with said detector,
- at least one sensing surface of variable shape on one of said detector and transmitter, and
- a sensing element on the other of said detector and transmitter disposed to travel over said sensing surface to emit a pulse to said warp beam drive for stepping said warp beam, said pulse corresponding to the operative distance which said sensing element travels over said sensing surface whereby said pulse is variable in time-of-occurrence and in duration.

2. The combination as set forth in claim 1 wherein said pulse transmitter is movable linearly.

3. The combination as set forth in claim 2 wherein said pulse transmitter is in strip form.

4. The combination as set forth in claim 1 wherein said pulse transmitter is rotatable.

5. The combination as set forth in claim 4 wherein said pulse transmitter is a disc and said sensing surface extends radially thereon.

6. The combination as set forth in claim 5 wherein said sensing surface is bounded by a cardioid curve.

7. The combination as set forth in claim 5 wherein said sensing surface is bounded by an involute curve.

8. The combination as set forth in claim 4 wherein said pulse transmitter is a cylinder and said sensing surface is disposed on the generated surface of said cylinder.

9. The combination as set forth in claim 8 wherein said sensing surface is substantially triangular.

10. The combination as set forth in claim 4 wherein said pulse transmitter is coupled to said machine drive.

11. The combination as set forth in claim 4 wherein said weaving machine is adapted to weave terry cloth and includes a rotatable cam for controlling cloth movement from said machine and wherein said pulse transmitter is coupled to said cam.

12. The combination as set forth in claim 1 wherein said weaving machine includes a movably mounted tension beam positioned in a warp path for response to changes in warp tension and wherein said sensing element is coupled to said tension beam to move therewith.

13. The combination as set forth in claim 1 wherein said sensing element is movable transversely of the direction of movement of said sensing surface.

14. The combination as set forth in claim 1 wherein said pulse transmitter is rotatable and said sensing element is movable transversely of the direction of movement of said sensing surface along selected circular arcs of different arcuate extent.

15. The combination as set forth in claim 1 wherein said sensing element is a proximity switch and said sensing surface is one of an electrically conductive surface and a dielectric exciting zone for cooperation with said proximity switch to energize said warp beam drive.

16. The combination as set forth in claim 1 wherein said sensing element is a proximity switch and said sensing surface is one of a magnetic zone and an optical exciting zone for cooperation with said proximity switch to energize said warp beam drive.

17. The combination as set forth in claim 1 wherein said weaving machine includes a movably mounted tension beam positioned in a warp path for response to changes in warp tension and wherein said sensing element is a proximity switch mounted on said detector, said detector being coupled to said tension beam to move therewith, and said sensing surface is one of an electrically conductive surface, a dielectric exciting zone, a magnetic zone and an optical exciting zone for cooperation with said proximity switch to energize said warp beam drive.

18. In a weaving machine, the combination comprising a warp beam for supplying warps, a warp beam drive for rotating said warp beam in an incremental motion;

a tension beam in the path of the warps for responding to changes in warp tension;

a machine drive; and a control means for controlling said warp beam drive, said control means including a detector coupled to said tension beam for responding to changes in warp tension, a pulse transmitter coupled to said machine drive to move in synchronism with a weaving cycle of said machine drive and in relative relation to said detector, at least one sensing surface of variable shape on one of said detector and transmitter, and a sensing element on the other of said detector and transmitter disposed to travel over said sensing surface to emit a pulse to said warp beam drive for stepping said warp beam, said pulse corresponding to the operative distance which said sensing element travels over said sensing surface whereby said pulse is variable in time-of-occurrence and in duration.

* * * * *